US007866373B2

(12) United States Patent
Hou et al.

(10) Patent No.: US 7,866,373 B2
(45) Date of Patent: Jan. 11, 2011

(54) HEAT PIPE WITH MULTIPLE WICKS

(75) Inventors: Chuen-Shu Hou, Tu-Cheng (TW); Tay-Jian Liu, Tu-Cheng (TW); Chao-Nien Tung, Tu-Cheng (TW); Chih-Hsien Sun, Tu-Cheng (TW)

(73) Assignee: Foxconn Technology Co., Ltd., Tucheng, Taipei County (TW)

( * ) Notice: Subject to any disclaimer, the term of this patent is extended or adjusted under 35 U.S.C. 154(b) by 1210 days.

(21) Appl. No.: 11/309,244

(22) Filed: Jul. 19, 2006

(65) Prior Publication Data

US 2007/0114008 A1 May 24, 2007

(30) Foreign Application Priority Data

Nov. 18, 2005 (CN) ..... 2005 1 0101568

(51) Int. Cl.
*F28D 15/00* (2006.01)
*H05K 7/20* (2006.01)

(52) U.S. Cl. ..... 165/104.26; 361/700

(58) Field of Classification Search ..... 165/104.26; 361/700

See application file for complete search history.

(56) References Cited

U.S. PATENT DOCUMENTS

| | | | | |
|---|---|---|---|---|
| 3,734,173 | A * | 5/1973 | Moritz | 165/104.26 |
| 4,109,709 | A * | 8/1978 | Honda et al. | 165/104.26 |
| 4,765,396 | A * | 8/1988 | Seidenberg | 165/104.26 |
| 5,046,553 | A * | 9/1991 | Lindner | 165/104.26 |
| 6,315,033 | B1 | 11/2001 | Li | |
| 6,725,910 | B2 * | 4/2004 | Ishida et al. | 165/104.26 |
| 2004/0188067 | A1 * | 9/2004 | Chau et al. | 165/104.26 |
| 2005/0230085 | A1 * | 10/2005 | Valenzuela | 165/104.26 |
| 2006/0086482 | A1 * | 4/2006 | Thayer et al. | 165/104.26 |
| 2007/0107878 | A1 * | 5/2007 | Hou et al. | 165/104.26 |
| 2007/0193723 | A1 * | 8/2007 | Hou et al. | 165/104.26 |
| 2007/0295485 | A1 * | 12/2007 | Liu et al. | 165/104.26 |
| 2008/0105405 | A1 * | 5/2008 | Hsu | 165/104.26 |

FOREIGN PATENT DOCUMENTS

| | | |
|---|---|---|
| CN | 1697171 | 11/2005 |
| WO | 2004094933 | 11/2004 |

* cited by examiner

*Primary Examiner*—Cheryl J Tyler
*Assistant Examiner*—Brandon M Rosati
(74) *Attorney, Agent, or Firm*—Jeffrey T. Knapp

(57) ABSTRACT

A heat pipe includes a metal casing (10) filled with a working fluid therein, a capillary wick (20) provided inside of the metal casing and a tube (30) contacting with a surface of the capillary wick. The metal casing includes an evaporating section (40), a condensing section (60) and an adiabatic section (50) between the evaporating section and the condensing section. A vapor passage (70) is formed inside of the casing and a liquid channel (80) is defined by the capillary wick. The working fluid in vapor state flows from the evaporating section towards the condensing section along the vapor passage and the working fluid in liquid state returns to the evaporating section from the condensing section along the liquid channel. The tube separates the vapor from the liquid at a place where the tube is located.

6 Claims, 10 Drawing Sheets

HEAT PIPE WITH MULTIPLE WICKS

FIELD OF THE INVENTION

The present invention relates generally to heat pipes as heat transfer/dissipating device, and more particularly to a heat pipe with a tube therein.

DESCRIPTION OF RELATED ART

Heat pipes have excellent heat-transferred performance due to their low thermal resistance, and therefore are an effective means for heat transfer or dissipation from heat sources. Currently, heat pipes are widely used for removing heat from heat-generating components such as central processing units (CPUs) of computers. FIGS. 7-8 show an example of a conventional heat pipe. The heat pipe includes a vacuum casing 1 containing a working fluid therein (not shown) and a capillary wick 2 attached to an inner surface of the casing 1. The casing 1 includes an evaporating section 4 at one end and a condensing section 6 at the other end. An adiabatic section 5 is provided between the evaporating and condensing sections 4, 6. The adiabatic section 5 is typically used for transport of the generated vapor from the evaporating section 4 to the condensing section 6. A vapor channel 7 is formed in a center of an inside of the casing 1. As the evaporating section 4 of the heat pipe is maintained in thermal contact with a heat-generating component, the working fluid contained in the evaporating section 4 absorbs heat generated by the heat-generating component and then turns into vapor. Due to the difference of vapor pressure between the evaporating and condensing sections 4, 6 of the heat pipe, the generated vapor moves towards and carries the heat simultaneously to the condensing section 6 along the vapor channel 7 and the vapor is condensed into liquid in the condensing section 6 after releasing the heat into ambient environment. FIGS. 9-10 are diagrammatically longitudinal cross-sectional views showing the opposite flowing paths between vapor and liquid states of the working fluid in the casing 1 of the heat pipe. Because of contacts of the heated vapor and the condensed liquid in the wick structure 2, it is possible to cause an entrainment limit to block circulations of the vapor and condensed liquid. The condensed liquid is heated before it reaches the evaporating section 4. Accordingly, heat-transfer ability of the heat pipe is weakened and heat dissipation efficiency of the heat pipe is lowered.

In view of the above-mentioned disadvantage of the conventional heat pipe, there is a need for a heat pipe having a good heat transfer effect.

SUMMARY OF THE INVENTION

A heat pipe in accordance with a preferred embodiment includes a metal casing containing a working fluid therein and a capillary wick provided in an inside of the casing. A tube is provided to contact with a surface of the capillary wick to separate the capillary wick from a vapor passage in the heat pipe.

Other advantages and novel features will become more apparent from the following detailed description of preferred embodiments when taken in conjunction with the accompanying drawings, in which:

BRIEF DESCRIPTION OF THE DRAWINGS

Many aspects of the present apparatus and method can be better understood with reference to the following drawings.

The components in the drawings are not necessarily drawn to scale, the emphasis instead being placed upon clearly illustrating the principles of the present apparatus and method. Moreover, in the drawings, like reference numerals designate corresponding parts throughout the several views.

DETAILED DESCRIPTION OF THE INVENTION

Figure 1:
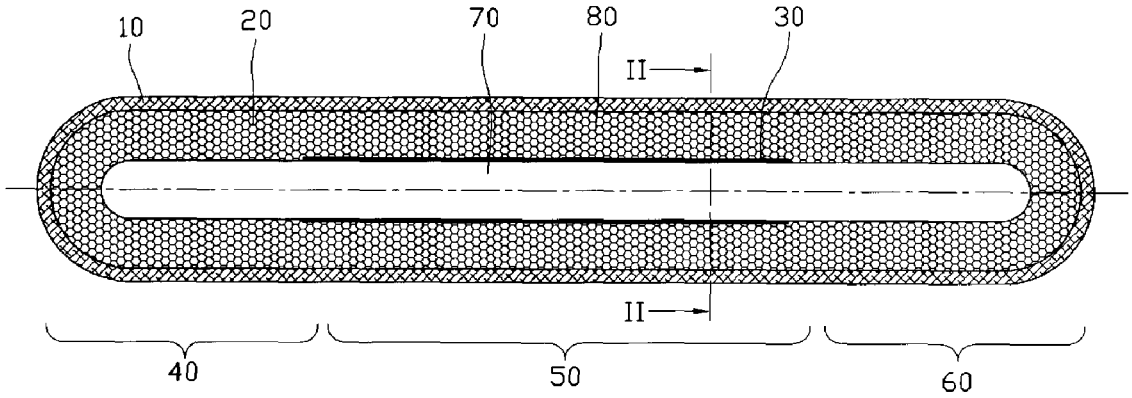
FIG. 1 is a longitudinal cross-sectional view of a heat pipe in accordance with a first embodiment of the present invention.
Figure 2:
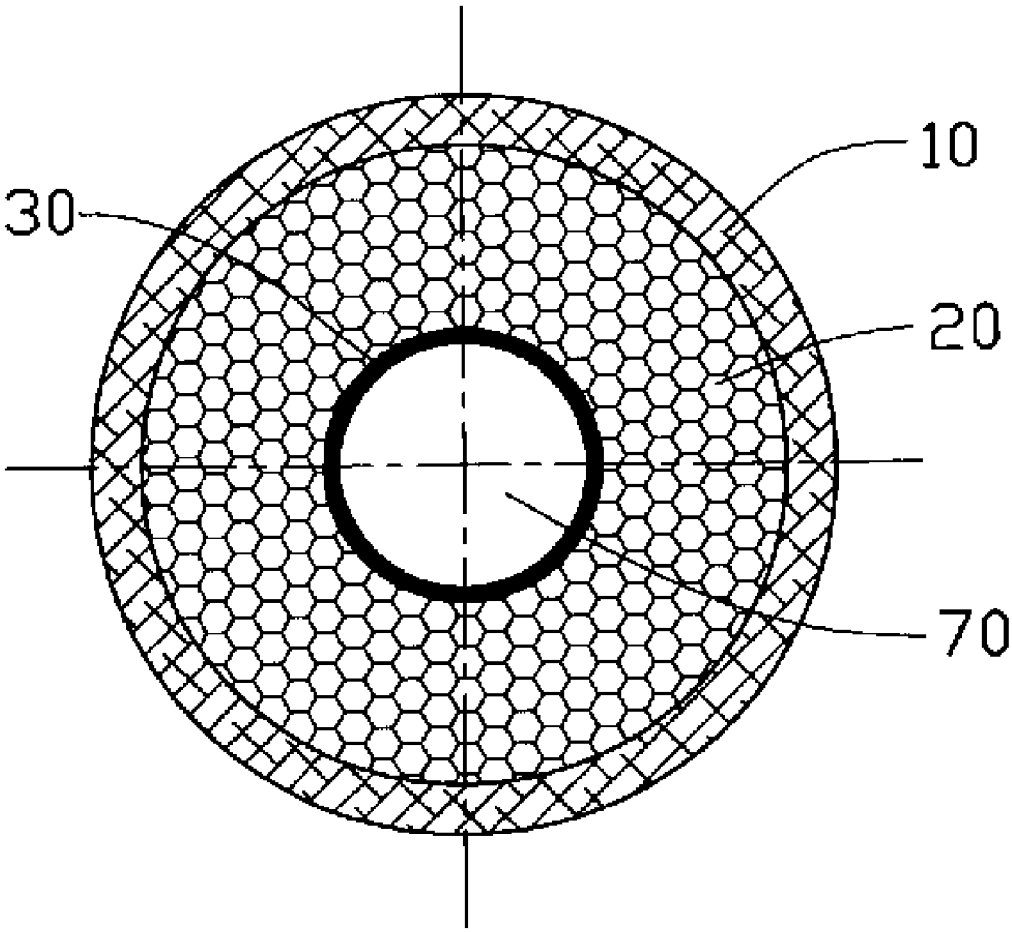
FIG. 2 is a radial cross-sectional view of the heat pipe in accordance with the first embodiment, taken along line II-II of FIG. 1.

FIGS. 1-2 show a heat pipe in accordance with a first embodiment of the present invention. The heat pipe comprises a metal casing 10 made of high thermally conductive materials such as copper or copper alloys, a working fluid (not shown) contained in the casing 10 and a capillary wick 20 arranged in an inner wall of the casing 10. The casing 10 comprises an evaporating section 40 at one end, a condensing section 60 at the other end and an adiabatic section 50 arranged between the evaporating section 40 and the condensing section 60. An inside of the casing 10 is divided into two parts by the capillary wick 20. One part forms a vapor passage 70 in a center of the inside of the casing 10 and the other part is the capillary wick 20 itself. A liquid channel 80 is defined by the capillary wick 20. A metal sheet is configured to form a tube 30. The metal tube 30 is mounted in the heat pipe in a manner contacting with the capillary wick 20 in the adiabatic section 50 of the casing 10 (best seen in FIG. 2). An outer surface of the tube 30 is attached on an inner surface of the capillary wick 20 in the adiabatic section 50 of the casing 10.

As the evaporating section 40 of the heat pipe is maintained in thermal contact with a heat-generating component (not shown), the working fluid contained in the evaporating section 40 absorbs heat generated by the heat-generating component and then turns into vapor. Due to the difference of vapor pressure between the evaporating and condensing sections 40, 60 of the heat pipe; the generated vapor moves towards and carries the heat simultaneously to the condensing section 60 along the vapor passage 70. The vapor is condensed into liquid in the condensing section 60 after releasing the heat into ambient environment. Because of an arrangement of the tube 30 at the adiabatic section 50 of the casing 10, the working fluid in vapor state flows only along the vapor passage 70 and the working fluid in liquid state is transported towards the evaporating section 40 via the liquid channel 80 in the capillary wick 20. The vapor and the liquid in the adiabatic section 50 are separated by the metal tube 30, which can avoid the adverse contact between the vapor and liquid. Thus, the condensed working fluid from the condensing section 60 can smoothly reach the evaporating section 40 and is prevented from being heated by the high temperature vapor at the adiabatic section 30. Abilities of heat-absorption and heat-dissipation of the working fluid of the heat pipe are enhanced and heat-transfer efficiency of the heat pipe is accordingly improved.

Figure 3:
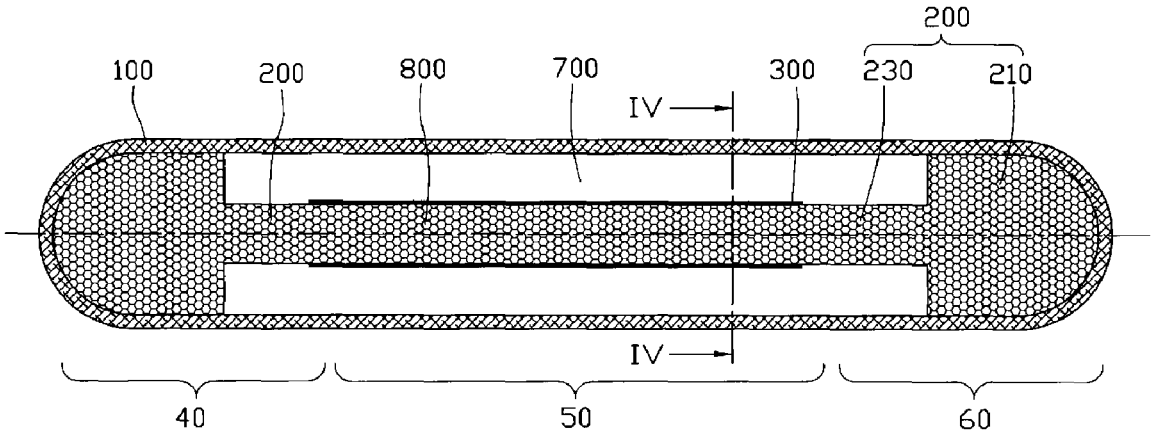
FIG. 3 is a longitudinal cross-sectional view of a heat pipe in accordance with a second embodiment of the present invention.
Figure 4:
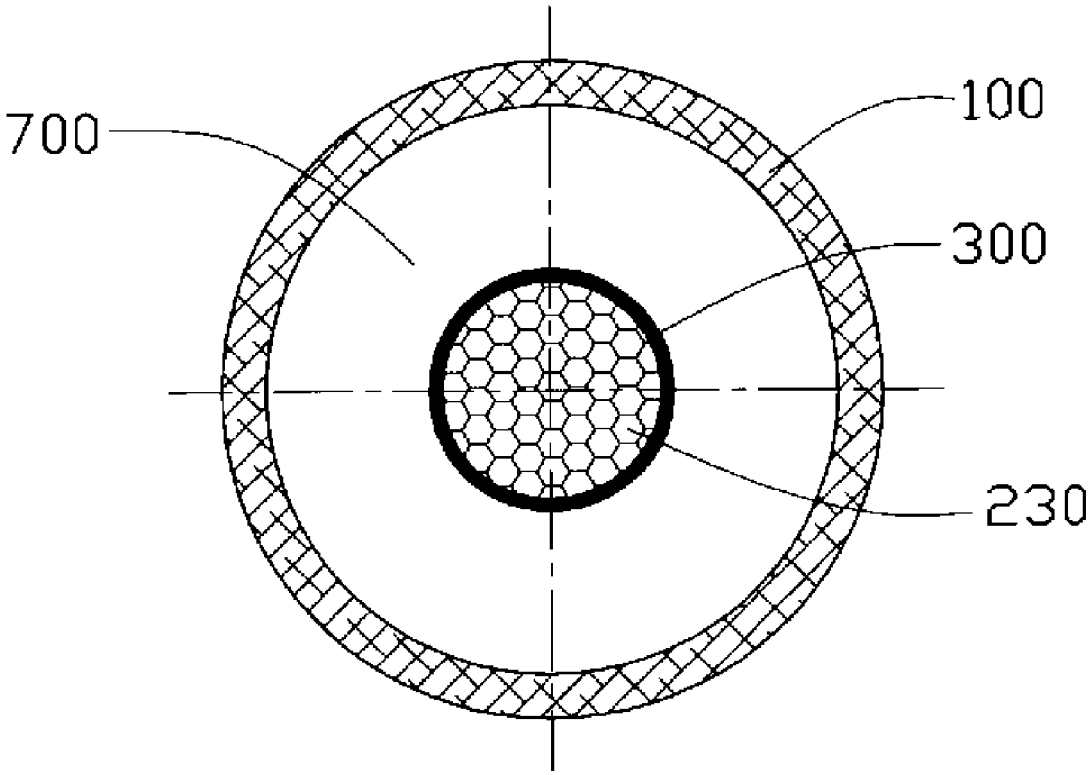
FIG. 4 is a radial cross-sectional view of the heat pipe in accordance with the second embodiment, taken along line IV-IV of FIG. 3.

FIGS. 3-4 illustrate a heat pipe according to a second embodiment of the present invention. The heat pipe comprises a metal casing 100, a capillary wick 200 provided in an inside of the casing 100 and a tube 300 contacting with the capillary wick 200. The capillary wick 200 comprises first capillary wicks 210 disposed in opposite ends of the casing 100, respectively, and a second capillary wick 230 interconnecting the first capillary wicks 210. The first capillary wicks 210 are arranged in the evaporating and condensing sections 40, 60 of the casing 100. The second capillary wick 230 extends in an axial direction of the casing 100. The tube 300 surrounds the second capillary wick 230 so that an inner surface of the tube 300 is attached with an outer surface of the second capillary wick 230 in the casing 100. The first capillary wicks 210 contact with the casing 100, while the second capillary wick is separated from the casing 100. A vapor passage 700 is provided between the tube 300 and an inner wall of the casing 100 and a liquid channel 800 is defined by the second capillary wick 230 and the first capillary wicks 210. The vapor passage 700 is separated from the second capillary wick 230 by the tube 300 at the adiabatic section 50. As the evaporating section 40 of the heat pipe absorbs the heat generated by the heat-generating component and then turns into vapor, the generated vapor moves towards and carries the heat simultaneously to the condensing section 60 along the vapor passage 700. The vapor entering into the first capillary wick 210 at the condensing section 60 is condensed into liquid and then the liquid is drawn back to the evaporating section 40 via the liquid channel 800 by a capillary force developed by the second capillary wick 200 and the first capillary wicks 210.

Figure 5:
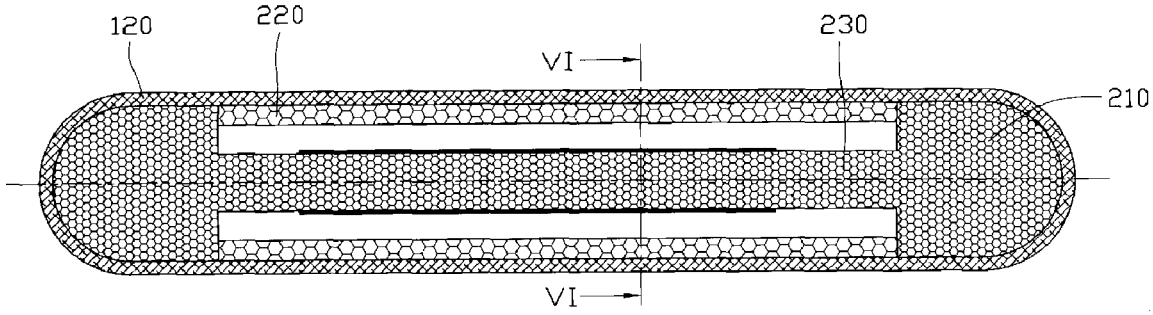
FIG. 5 is a longitudinal cross-sectional view of a heat pipe in accordance with a third embodiment of the present invention.
Figure 6:
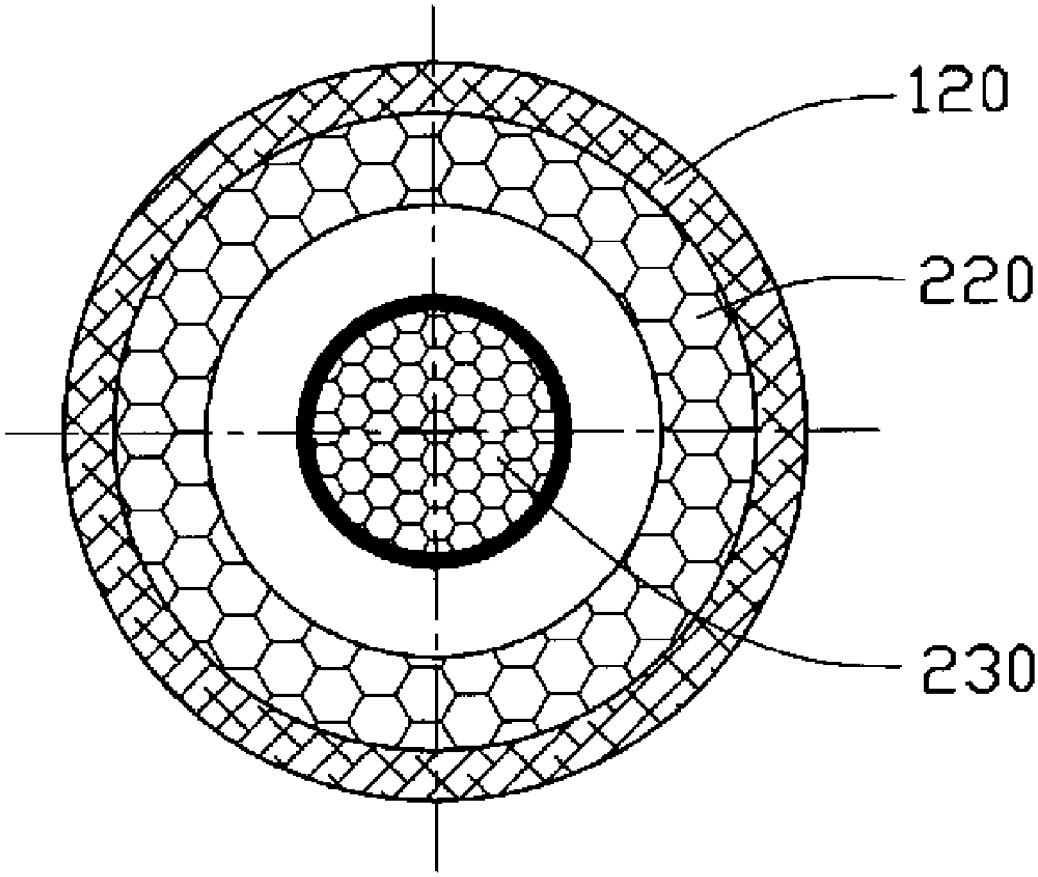
FIG. 6 is a radial cross-sectional view of the heat pipe in accordance with the third embodiment, taken along line VI-VI of FIG. 5.
Figure 7:
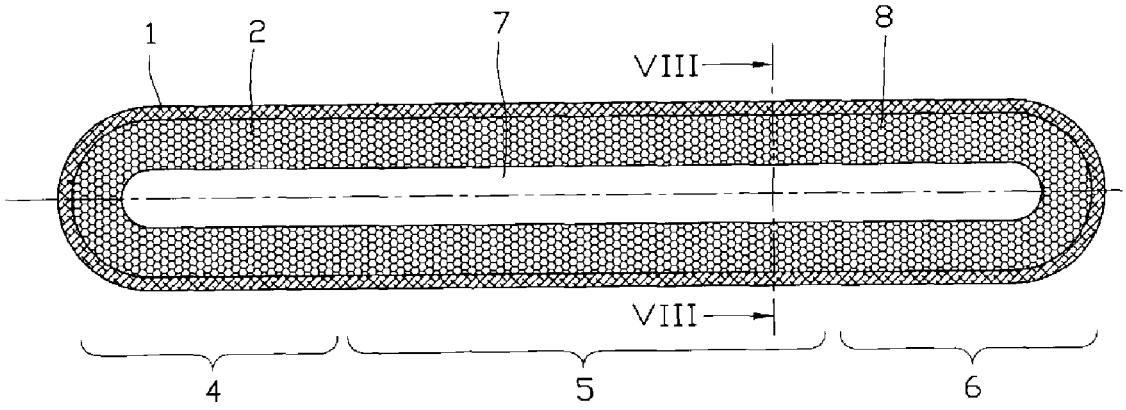
FIG. 7 (PRIOR ART)
FIG. 7 is a longitudinal cross-sectional view of a conventional heat pipe.
Figure 8:
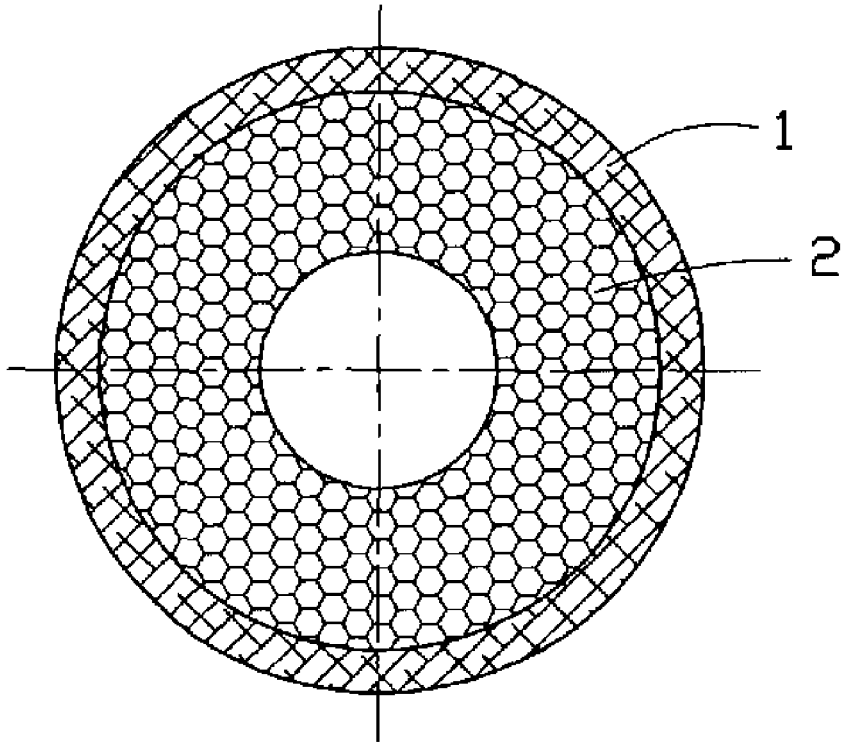
FIG. 8 (PRIOR ART)
FIG. 8 is a radial cross-sectional view of the conventional heat pipe, taken along line III-III of FIG. 7.
Figure 9:
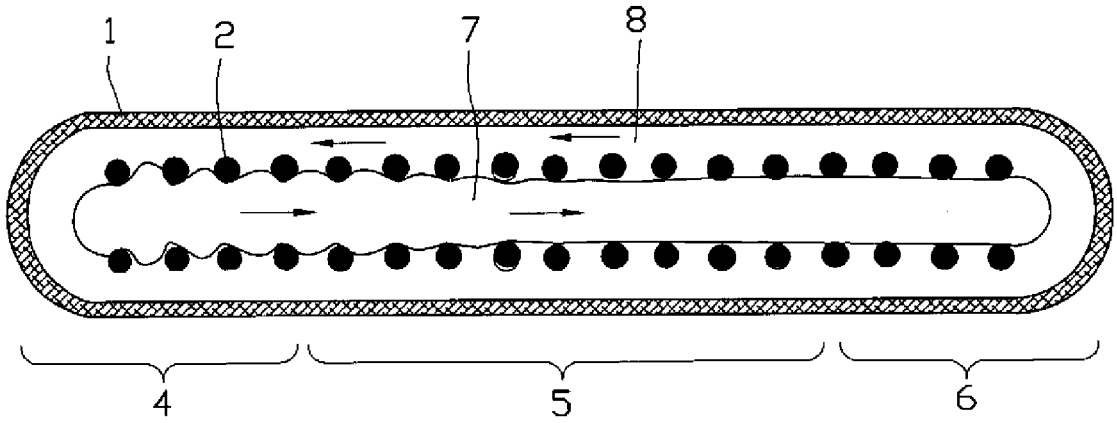
FIG. 9 (PRIOR ART)
FIG. 9 is a diagrammatically longitudinal cross-sectional view showing vapor and liquid moving paths of the conventional heat pipe of FIG. 7.
Figure 10:
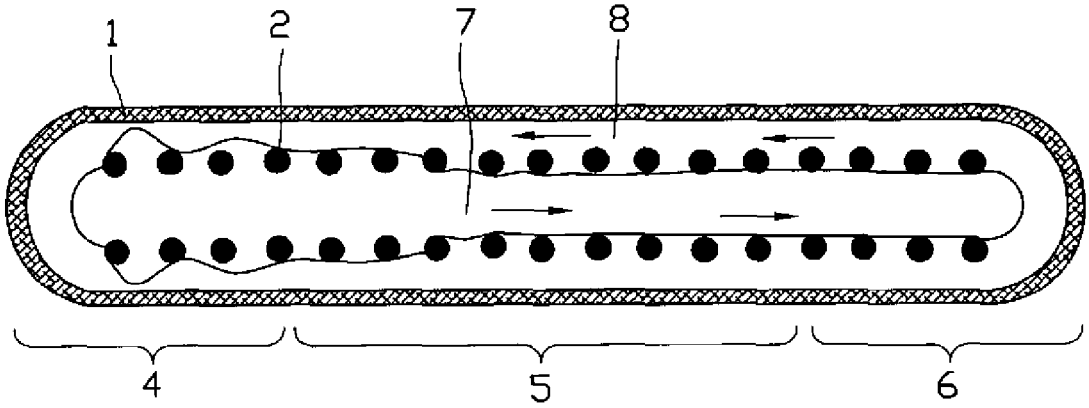
FIG. 10 (PRIOR ART)
FIG. 10 is another diagrammatically longitudinal cross-sectional view showing the vapor and liquid moving paths of the conventional heat pipe of FIG. 7.

FIGS. 5-6 illustrate a heat pipe according to a third embodiment of the present invention. Differences of the heat pipe between the second and third embodiments are that the heat pipe in the third embodiment comprises a casing 120 and a third capillary wick 220 arranged in an inner surface of the casing 1 20 corresponding to the second capillary wick 230. The third capillary wick 220 is a thin layer disposed on the inner wall of the casing 120. The third capillary wick 220 has pores larger than those in the first and second capillary wicks 210, 230, whereby the third capillary wick 220 has a lower flow resistance. By the provision of the third capillary wick 220, condensed liquid can be ensured to have a more smooth flow back to the evaporating section of the heat pipe.

The tubes 30, 300 in the preferred embodiments are made of metal sheet. Alternatively, they can be made of metal mesh. The tubes 30, 300 are made of metal materials such as copper or aluminum. Alternatively they can be made of non-metal material such as plastics or resin. A cross-sectional area of the tubes 30, 300 can also be square or rectangular, according to the shape of heat pipe.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A heat pipe comprising:

a metal casing having an inner wall therein and defining an evaporating section for receiving heat and a condensing section for releasing heat;

a working fluid received in the metal casing and evaporated into vapor in the evaporating section and condensed into liquid in the condensing section;

a capillary wick provided inside the metal casing, the capillary wick comprising first capillary wicks arranged in the evaporating and condensing sections, respectively, a second capillary wick extending in an axial direction of the casing and interconnecting the two first capillary wicks, and a third capillary wick disposed on a portion of the inner wall of the casing and interconnecting the first capillary wicks, the second capillary wick being separated from the inner wall of the casing;

a tube surrounding the second capillary wick; and a vapor passage formed between the tube and an inner surface of the third capillary wick, and a liquid channel defined in the capillary wick;

wherein the vapor in the evaporating section flows towards the condensing section of the casing along the vapor passage and the liquid in the condensing section of the casing returns to the evaporating section along the liquid channel, the tube separating the vapor passage and the liquid at a place where the tube is located.

2. The heat pipe as claimed in claim 1, wherein the metal casing further comprises an adiabatic section disposed between the evaporating section and the condensing section, and the tube is located at the adiabatic section.

3. The heat pipe as claimed in claim 2, wherein the third capillary wick is disposed on the inner wall of the casing at the adiabatic section.

4. The heat pipe as claimed in claim 1, wherein the third capillary wick has a liquid flow resistance lower than that of the first and second capillary wicks.

5. The heat pipe as claimed in claim 1, wherein the tube is made of metal.

6. The heat pipe as claimed in claim 1, wherein the tube is made of one of plastics and resin.

* * * * *